US008007329B2

(12) United States Patent
Wengren, Jr.

(10) Patent No.: US 8,007,329 B2
(45) Date of Patent: Aug. 30, 2011

(54) CUTTING SYSTEM FOR FOULING REMOVAL FROM JET DRIVE WATER INTAKE

(76) Inventor: Richard E. Wengren, Jr., South Freeport, ME (US)

( * ) Notice: Subject to any disclaimer, the term of this patent is extended or adjusted under 35 U.S.C. 154(b) by 230 days.

(21) Appl. No.: 12/473,008

(22) Filed: May 27, 2009

(65) Prior Publication Data

US 2010/0304628 A1 Dec. 2, 2010

(51) Int. Cl.
*B63H 11/01* (2006.01)

(52) U.S. Cl. ..... 440/46

(58) Field of Classification Search ..... 440/38, 440/46, 47, 73

See application file for complete search history.

(56) References Cited

U.S. PATENT DOCUMENTS

| | | | | |
|---|---|---|---|---|
| 732,568 | A * | 6/1903 | Lee | 440/73 |
| 1,676,830 | A * | 7/1928 | Larsen | 126/173 |
| 2,719,547 | A | 10/1955 | Gjerde | |
| 2,826,032 | A | 3/1958 | Hayes | |
| 3,046,735 | A | 7/1962 | Burgin | |
| 3,094,965 | A | 6/1963 | Burgin | |
| 3,109,407 | A | 11/1963 | Dorst | |
| 3,909,411 | A | 9/1975 | Angele et al. | |
| 4,246,862 | A | 1/1981 | Deal | |
| 4,911,664 | A * | 3/1990 | Gremillion | 440/73 |
| 5,468,165 | A | 11/1995 | Weber et al. | |
| 5,505,639 | A | 4/1996 | Burg | |
| 5,577,941 | A | 11/1996 | Chartier | |
| 5,876,258 | A | 3/1999 | Gray | |
| 6,033,272 | A | 3/2000 | Whiteside | |
| 6,045,418 | A | 4/2000 | Roos | |
| 6,083,063 | A | 7/2000 | Neisen | |
| 6,183,319 | B1 | 2/2001 | Ishigaki | |
| 6,482,055 | B1 * | 11/2002 | Freitag | 440/46 |
| 7,377,826 | B1 * | 5/2008 | Wengren, Jr. | 440/46 |
| 2009/0061704 | A1 | 3/2009 | Rui | |

OTHER PUBLICATIONS

Husick, Chuck, Going Propless: Water-jet drives, long a curiosity, are now turning up on almost everything, Yachting Magazine, Sep. 2005, www.yachtingmagazine.com, 2pp.

Wilkinson, Stephan, Hand-Built, Wood-Trimmed, Jet-Powered, Popular Science, Mar. 2004, www.popsci.com, 2pp.

Hydro Surge Grate for Merc Jet Drive, Boating Forum, Jul. 2006, www.forums.iboats.com, 2pp.

HydroSurge Weedless Grate . . . Not So Great!, JetBoater's Forum, Jul. 2002, www.network54.com, 9pp.

International Search Report and Written Opinion in corresponding PCT application serial No. PCT/US10/01546, Oct. 8, 2010, 9 pp.

* cited by examiner

*Primary Examiner* — Stephen Avila

(74) *Attorney, Agent, or Firm* — Verrill Dana, LLP; Chris A. Caseiro

(57) ABSTRACT

A cutting system for fouling removal systems used in water-jet drive systems is described. The cutting system includes an actuation system for facilitating movement of a cutting blade that resides outside of the water flow area for the intake of the jet drive system. The cutting system also includes one or more guide tines to restrict movement of the cutting blade away from the surface of the grate. An optional cutter stud is formed as a single structure including two members forming a single angle, one member for mounting and the other for cutting. The single-angled configuration maximizes cutting efficiency while minimizing disruption of water flow to the propulsion system.

23 Claims, 3 Drawing Sheets

CUTTING SYSTEM FOR FOULING REMOVAL FROM JET DRIVE WATER INTAKE

CROSS REFERENCE TO RELATED APPLICATION

The present application is related to U.S. patent application Ser. No. 11/769,972, filed Jun. 28, 2007, entitled "FOULING REMOVAL SYSTEM FOR JET DRIVE WATER INTAKE" of the same named inventor, from which application issued U.S. Pat. No. 7,377,826. The entire contents of that prior application and patent are incorporated herein by reference.

BACKGROUND OF THE INVENTION

1. Field of the Invention

The present invention relates to systems for the removal of fouling materials such as seaweed and eel grass that can clog the intakes of jet drives. More particularly, the present invention relates to a cutting assembly arranged to resist separation from the intake grate of a jet drive. The present invention also relates to a cutting blade positioned adjacent to the impeller of the jet drive to provide improved cutting capability for the system to remove fouling from the jet drive impeller.

2. Description of the Prior Art

Watercraft have traditionally been, and primarily are, propelled through water by propellers. An alternative propulsion mechanism gaining interest is the water-jet drive. Water-jet drive systems provide a number of advantages over propeller-driven systems. They eliminate a number of support and attachment components, such as rudders, propeller shafts, propellers, that increase vessel drag and limit shallow water passage. Moreover, they are safer for people and marine life in proximity to the stern of the vessel in that the moving parts are located within the hull envelope. They also tend to be quieter than propeller systems and maneuverability is enhanced at all speeds. Water-jet drives also tend to provide increased fuel economy. For these and other reasons, the water-jet drive has become increasingly popular as a watercraft propulsion system.

Water-jet drive systems propel watercraft by rapidly accelerating a relatively small volume of water over a distance. This is accomplished using one or more impeller stages located within the watercraft hull. The impeller includes a plurality of blades confined in a housing. Rotation of the impeller blades draws water into an intake of the housing, past the blades, and through an outlet at the stem. The housing is ordinarily designed to direct flow such that the water is expelled above the waterline of the watercraft. The housing may be tapered toward the outlet to increase water acceleration and maximize thrust. Improved propulsion efficiency occurs when there is a close fit between the ends of the impeller blades and the interior of the housing.

An important aspect in the effective operation of the water-jet drive is the availability of an adequate supply of water to be expelled from the housing outlet. For that reason, in general, a larger intake is desirable as it ensures a greater water supply available to the impeller to generate thrust. On the other hand, a large intake allows the impeller to draw debris in with the water. It is desirable to minimize debris contact with the impeller, which debris may damage or destroy the blades or clog the impeller. It is therefore useful to avoid or minimize drawing into the housing debris of any size or type that will cause damage or fouling of the impeller while keeping the intake as open as possible.

Manufacturers of watercraft using water-jet drives place intake grates at the housing intake to catch relatively large-sized debris and prevent such debris from reaching the impeller. In relatively clear water, these grates serve their purpose adequately. However, when the watercraft passes through patches of heavy debris—seaweed and eel grass in particular—the grate is overwhelmed and the intake is substantially blocked. In other instances, this type of debris or fouling passes through the grate and then sticks to the front leading edges of the blades of the impeller within the housing. Either type of fouling results in a substantial reduction of thrust capability and corresponding slowing or halt to movement of the watercraft. Unexpected substantial slowing or halting of the watercraft can be a serious safety issue for the watercraft operator and occupants, dependent upon sea conditions, weather and location.

Water-jet drive watercraft operators resolve such fouling problems in several ad hoc ways. First, they may reverse the direction of rotation of the impeller to force the fouling to move away from the intake in the hope that it will be dislodged from the grate. Second, they attempt to access the housing through an observation port below the deck and try to pull out any fouling contained therein. Third, they may be forced to jump into the water, swim under the watercraft, and pull the fouling away from the grate by hand. These options are either ineffective or an undesirable way to solve the problem. Examples of described devices can be found in U.S. Pat. Nos. 6,482,055; 6,183,319; and 6,083,063. However, these devices and the ad hoc techniques described above fail to address adequately the problem of fouling removal in water-jet drives. Worse, these ad hoc methods and described devices require that the watercraft be completely stopped before they can be performed or used. Therefore, not only are they ineffective at removing debris, they interrupt an otherwise enjoyable sail. When they must be performed or used repeatedly, which is often the case, given their ineffectiveness, the sailing experience can be ruined entirely. In order to reverse the impeller to "backflush" the water-jet drive housing in the hope of dislodging the debris on the grate, it is necessary to have a transmission coupled to the impeller to effect that reversal. The transmission is a costly and heavy component that must also be maintained. It would be preferable to avoid addition of a transmission for the purpose of changing impeller rotation.

U.S. Pat. No. 7,377,826 describes a system capable of removing fouling materials from the intake of a water-jet drive. That system provides a fouling removal system that may be incorporated into existing water-jet drive structures or incorporated into new construction. Further, that fouling removal system may be operated automatically using a control device in proximity to other control devices of the watercraft. Still further, that fouling removal system does not require the inclusion of a transmission to enable impeller rotation changes. Yet further, that fouling removal system includes a secondary mechanism for removing debris fouling the impeller blades of a water-jet drive. Even further, that fouling system is capable of removing debris from the intake grate and impeller of a water-jet drive while a watercraft is stationary or is operating at any speed, including full speed.

However, the fouling removal system described in U.S. Pat. No. 7,377,826 has certain features that limit the optimization of its performance characteristics. First, the mechanism for cutting the debris from the grate of the propulsion system may not be able to cut through large bunches of seaweed as the bulk of the blockage forces the blade to ride over the seaweed. Also, high water flow rates through the grate may cause the blade to lift as it is actuated. In both instances, in sufficient quantities of seaweed or eel grass are sheared. In particular, the degree and frequency of blade lifting away from the grate may increase with increased seaweed bulk and/or when the boat is traveling at high speeds. Second, the actuation mechanism of the existing system is positioned at least partially in the flow path of water passing through the grate. That positioning can be a point of debris retention that cannot be resolved with the cutter. It also creates turbulence, which can create noise as well as lessen the efficiency of the water-jet drive. Third, the passive cutter stud of the system described in U.S. Pat. No. 7,377,826 has shown effective removal of debris located on or near the impeller, but there remains some seaweed clogging near the shaft of the impeller. It would be preferable to be remove all, or substantially all, such debris from the impeller including near the impeller shaft. Fourth, it can be difficult to place the passive cutter stud sufficiently close to the impeller to enable effective debris removal at that location.

SUMMARY OF THE INVENTION

It is an object of the present invention to provide enhanced performance to a system capable of removing fouling materials from the intake of a water-jet drive and impeller. It is also an object of the invention to eliminate the separation of the blade from the grate during the cutting process to improve performance. Still further, it is an object of the present invention to provide enhanced cutting capability to a fouling removal system. Yet further, it is an object of the present invention to provide a fouling removal system with improved performance and cutting capability under all conditions of operation of a vessel with a water-jet drive.

These and other objects are achieved with the present invention, which is a cutting system for cutting away seaweed, eel grass, and other similar types of stringy or otherwise clinging debris from the intake of a waterjet drive. The cutting system includes a cutting blade and a set of guide tines configured to restrict vertical movement of the cutting blade as it passes along the surface of the intake grate of a water-jet drive. In particular, the one or more guide tines form a confined area between the tines of the intake grate and those guide tines. Each guide tine forms a slot through which the cutting blade passes. The upper portion of the guide tine is spaced from its lower portion, or from a grate tine, enough to allow the cutting blade to pass there between while also preventing the cutting blade from lifting away from the grate tines during the cutting process. The cutting system also includes an actuator system for moving the cutting blade that is located adjacent to, but outside of, the cutting area and outside of the flow path for water entering the propulsion system.

The cutting system includes an optional passive cutter stud located within the housing adjacent to the impeller. The cutter stud includes a sharpened surface at least at its leading edge. The cutter stud is affixed to the interior of the housing near the impeller blade such that any debris buildup on the leading edge of the impeller blades contacts the sharpened surface and is cut into pieces to pass through the impeller. The cutter has a cutting edge that is shaped and located to minimize its distance from the leading edge of the impeller. The minimal clearance provided by this arrangement provides optimum cutting capability. The shape of this improved cutter stud decreases resistance to water flow and increases cutting ability.

The cutting system of the present invention enables the removal of fouling materials from the intake grate of a water-jet drive. The present invention may be incorporated into the control functions of the watercraft. The actuation system of the invention may be incorporated into hydraulic supply arrangements existing in the watercraft.

The cutting system enhances the ability of a fouling removal system to permit a watercraft operator to remove fouling at the intake grate without manual removal action. It cuts away the debris to ensure that the debris will not remain on the grate. These enhancements are especially valuable when the volume of water passing through the grates is higher, such as when the vessel is traveling at high rates of speed. Additionally, the present invention enhances the ability of fouling removal systems to substantially and efficiently keep the water-jet drive housing clear of debris so that the watercraft remains fully operational and is not suddenly and unexpectedly incapacitated when passing through seaweed. That enhances watercraft safety.

These and other advantages of the present invention will become apparent upon review of the following detailed description, the accompanying drawings and the appended claims.

DETAILED DESCRIPTION OF THE PREFERRED EMBODIMENT

Figure 1:
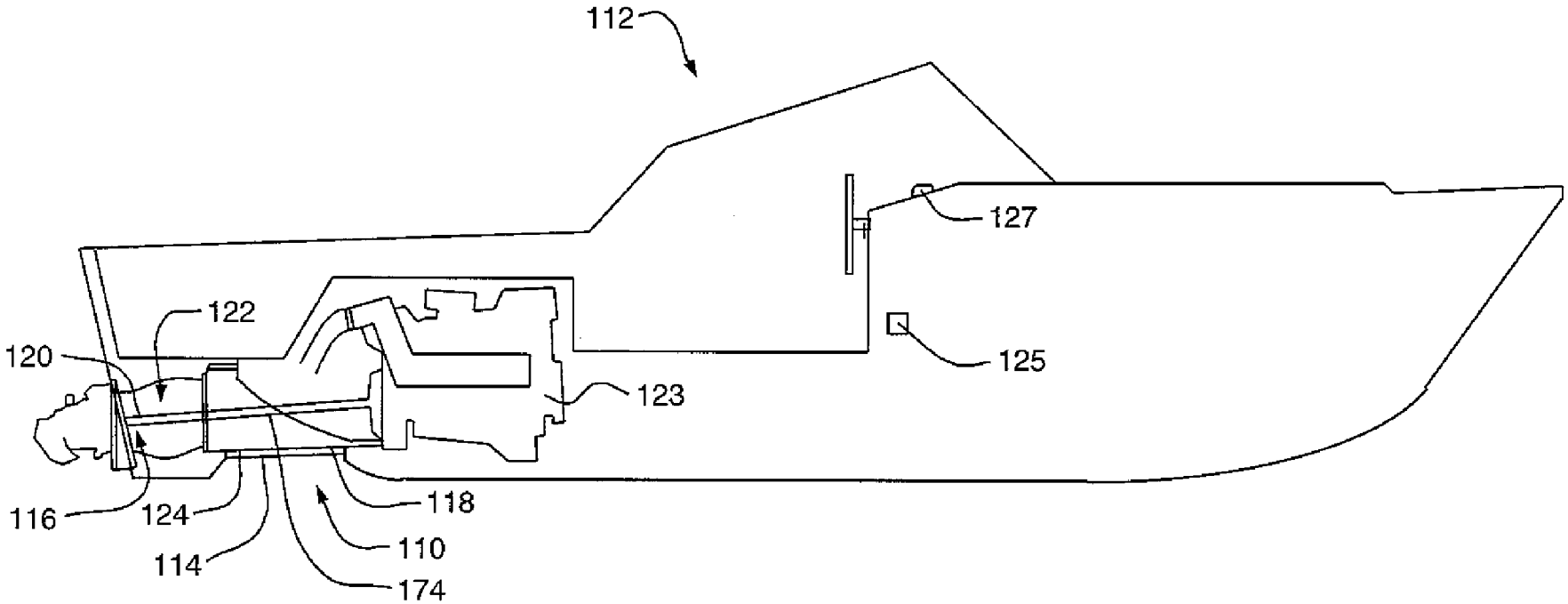
FIG. 1 is an elevation view of a watercraft including the cutting system for fouling removal of the present invention.

The present invention is a cutting system 110 for removing fouling such as seaweed, eel grass, or the like, from the intake grate of a water-jet drive system of a watercraft while the watercraft is stationary or is operating at any speed, including full speed. With reference to FIG. 1, the cutting system 110 is shown in position with respect to a watercraft 112. The cutting system 110 includes a cutter arm system 114 and, optionally, a cutter stud 116. The cutting system 110 is designed to cut away debris clogging an intake grate 118 and/or an impeller 120 within a housing 174 of the water-jet drive system 122. The water-jet drive system 122 is coupled to an engine 123. The cutter arm system 114 is coupled to a hydraulic pump 125 and is may be automatically actuated using a control switch 127. In one embodiment of the invention, the cutting system 110 includes the intake grate 118 having a frame 124. In this arrangement, the cutting system 110 includes a grate assembly to be described with reference to FIGS. 2 and 3. In an alternative embodiment, the cutting system 110 does not include a grate assembly, but instead may be affixed to an existing grate 118.

Figure 3:
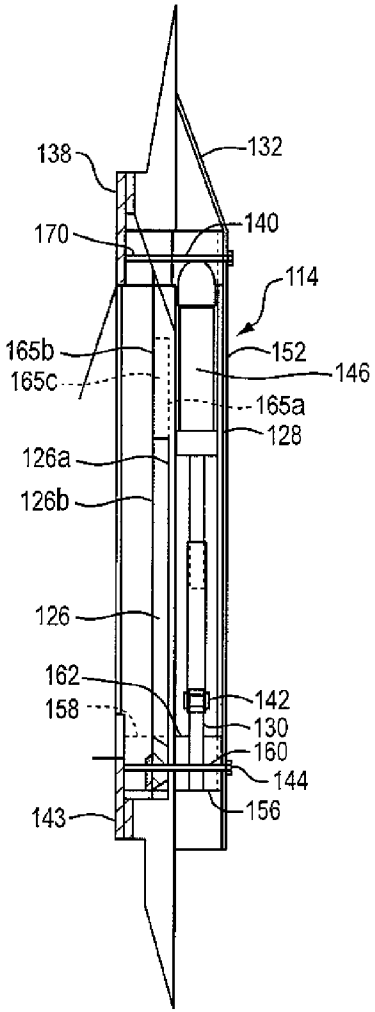
FIG. 3 is a side view of the cutter arm system.
Figure 2:
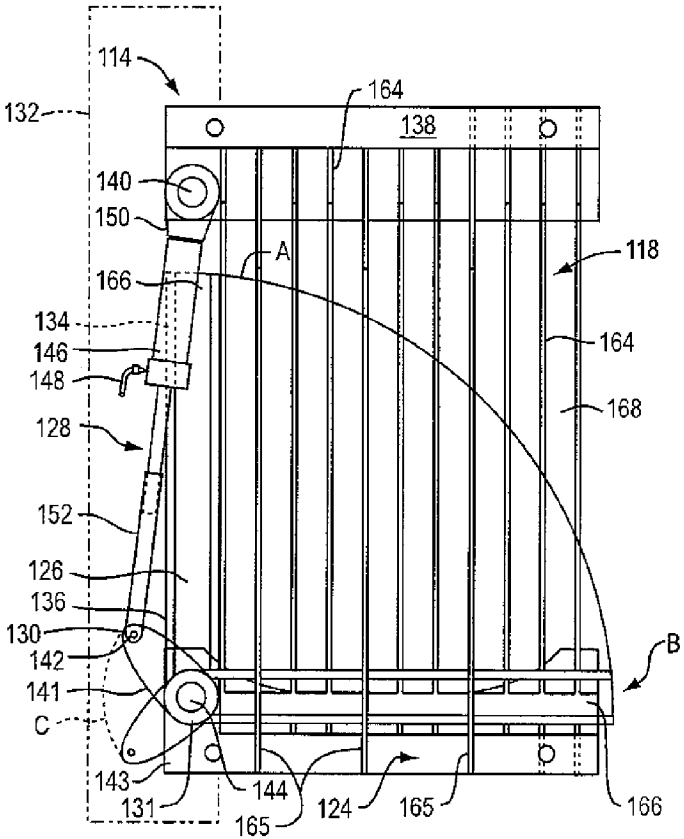
FIG. 2 is a plan view of the cutter arm system for fouling removal of the present invention.
Figure 6:
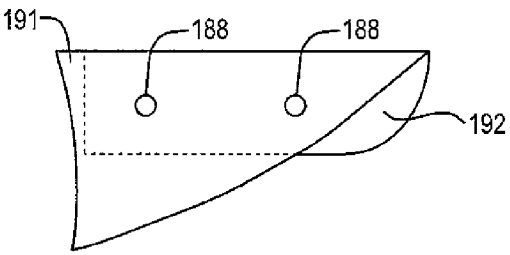
FIG. 6 is a top view of the cutter stud of FIG. 4, showing the first member in phantom.
Figure 7:
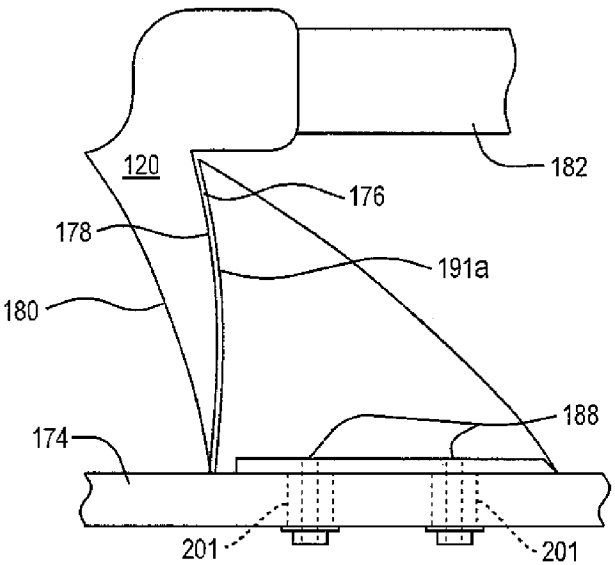
FIG. 7 is a side view of the cutter stud of FIG. 4 affixed to the water-jet drive housing interior in close proximity to a blade of the impeller.
Figure 5:
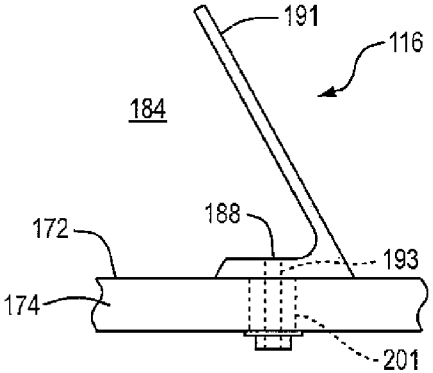
FIG. 5 is a second, close up front view of the cutter stud of FIG. 4 affixed to the water-jet drive housing interior.
Figure 4:
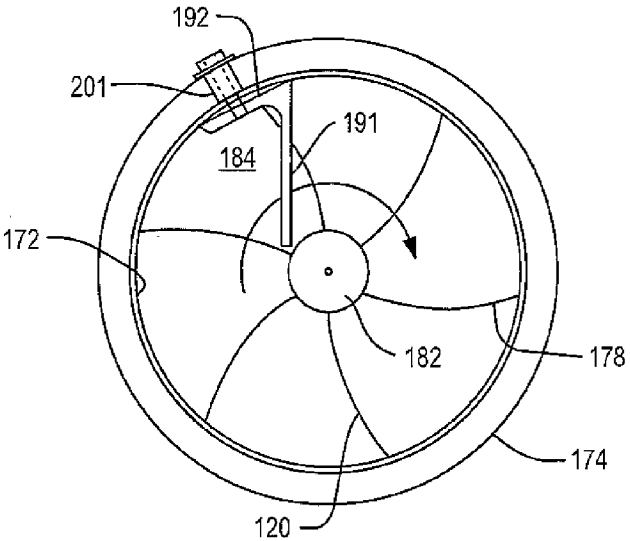
FIG. 4 is a first front view of the cutter stud of the present invention affixed to the water-jet drive housing interior.

As illustrated in FIGS. 2 and 3, the cutter arm system 114 includes a blade 126, an actuation system 128, a first pivot assembly 130, a second pivot assembly 131, and a blade housing 132. The blade 126 includes a first surface **126*a* and a second surface 126*b*. One or both of the blade surfaces may be sharp. The blade 126 is shown at a first position A retracted within the blade housing 132 and in a second position B extended out of the blade housing 132. The cutter arm system 114 includes a forward end 134 and a rear end 136. The forward end 134 is removably affixed to a forward mounting plate 138 of the frame 124 using first bolt 140. The rear end 136 is removably affixed to the first end of a pivot plate 141 using first pivot bolt 142. The second end of the pivot plate 141 is removably affixed to the rear mounting plate 143 of the frame 124 using second pivot bolt 144. The blade housing 132 is affixed to the forward mounting plate 138 using the first bolt 140 and to the rear mounting plate 143 using the second pivot bolt 144. The cutter arm assembly 114 is preferably mounted exterior to the intake grate 118, wherein the frame 124 and tines (described herein) of the intake grate 118 are positioned within the opening of, and affixed to, the mounting block of the watercraft 112 substantially flush with the mounting block while the cutter arm assembly 114 extends outwardly from the plane of the opening of the mounting block. It is to be understood that other means for joining the cutter arm assembly 114 to the watercraft 112 at the intake of the water jet drive system may be employed without deviating from the basic functionality of the cutter arm assembly 114. For example, the cutter assembly 114 may be connected at the interior of the watercraft 112 by joining it to the interior side of the mounting block with the second pivot bolt 144 extending through the mounting block and rotatably joined to the blade 126 such that the frame and tines set within the mounting block opening and the cutter arm assembly 114 is substantially flush with the mounting block. The present invention, along with other structures, such as the watercraft shaft, for example, may then be essentially contained within the watercraft 112 and provide improved hydrodynamics. It is to be noted that the cutter arm assembly 114 may be connected to the housing 174 of the water jet drive system 122 instead of being connected directly to the watercraft 112, wherein the water jet drive system 122 is connected to the mounting block of the watercraft 112**.

The actuation system 128 includes a hydraulic cylinder 146 removably connected to the forward mounting plate 138 and the blade 126, and hydraulic fluid transport means, such as flexible piping 148, coupled to the hydraulic pump 125. The hydraulic cylinder 146 includes a first end 150 and a second end 152. The first end 150 is engaged with the first bolt 140 and is therefore fixedly connected to the forward mounting plate 138. The second end 152 is affixed to pivot plate 141 with the first pivot bolt 142. The pivot plate 141 is affixed to the blade 126 at the first surface 126*a* with the second pivot bolt 144. The hydraulic cylinder 146 is arranged to be positioned between the blade 126 and the blade housing 132 when the blade 126 is in retracted position A. The hydraulic cylinder 146 is sized and arranged to provide sufficient force to cause movement of the blade 126 when actuated by operation of the hydraulic pump 125. It is to be understood that other means may be used for joining the hydraulic cylinder 146 to the forward mounting plate 138 and the blade 126.

With continuing reference to FIGS. 2 and 3, the second pivot assembly 131 includes a housing bushing 156 in rotatable engagement with the second pivot bolt 144 and a mounting bushing 158 affixed to the rear mounting plate 142 and to the housing bushing 156. The housing bushing 156 includes a first end 160 rotatably coupled to an interior surface of the blade housing 132 and a second end 162 removably coupled to the first surface 126*a* of the blade 126. The housing bushing 156 may have male threading at the first end 160 and the second end 162 as the means for engagement with the blade housing 132 and the blade 126, but is not limited thereto. The housing bushing 156 is preferably fixedly engaged with the blade 126 such that they rotate in unison when the blade 126 is moved by operation of the hydraulic cylinder 146.

As an improvement over the cutting system described in U.S. Pat. No. 7,377,826, the cutting system 110 of the present invention includes one or more guide tines 165. The guide tines 165 are configured as slotted structures. Each includes an upper structure 165*a* and a lower structure 165*b*. The structures 165*a* and 165*b* are spaced from one another by a gap 165*c*, which is sized and shaped to permit the blade 126 to pass therethrough. That is, under structure 165*a* and over structure 165*b*. In this way, the blade 126 is prevented from lifting away from structure 165*b* and from any of grate tines 164, which are not slotted and which are affixed to the grate frame 124. In an alternative embodiment, the guide tines 165 are not slotted. Instead, each is positioned above one of the grate tines 164 in a configuration that creates a gap there between so as to produce the slotted arrangement through which the blade 126 may pass when actuated.

When the watercraft 112 is functioning as expected and there are no apparent indications of reduced efficiency of the water-jet drive system 122, the actuation system 128 is dormant and the blade 126 is retracted within the housing 132 out of the cross sectional area of water flow through the intake grate 118. When the watercraft operator detects a reduction in efficiency of thrust, the actuation system 128 may be activated through switch 127 to cause the extension of the hydraulic cylinder 146 such that the second end 152 moves along a path identified as path C. The movement of the hydraulic cylinder 146 along path C causes the pivot plate 141 to rotate, which in turn causes the blade 126 affixed thereto to swing out of the blade housing 132 in an arc from position A to position B. The first and second pivot assemblies 130, 131, cause the movement of the blade 126 by each pivoting in opposite directions, which keeps the hydraulic cylinder 146 outside of the portion of the intake grate 118 through which water flows during operation, allowing water to flow to the propulsion system with minimum interference.

The blade 126 at second surface 126*b* passes in close proximity above or flush against tines 164 of the intake grate 118 and through guide tines 165. The second surface 126*b* may be sufficiently sharpened to ensure that all debris located on the tines 164 is severed and allowed to pass either into the housing 174 of the water-jet drive system 122 (shown in FIG. 1) or below, and therefore completely removed from, the watercraft 112. As noted, either or both surfaces of the blade 126 may be sharpened enough to enable the cutting of debris upon actuation. In addition, a shear plate of the intake grate 118 may be similarly sharpened so that as blade 126 approaches it upon actuation, the blade 126 and the shear plate produce a scissoring effect to shear off debris located on the intake grate 118. It is to be noted that one or more portions or all parts of the cutting components of the cutting system 110 may be carbide or other type of material, such as nonmetallic materials including, but not limited to, composite materials. Other components of the cutting system may also be made of such materials, provided such materials are selected to perform the indicated functions under the conditions expected for the watercraft 112. The movement of the blade 126 may be reversed such that it swings back across the intake grate 118 between the gap 165*c* formed by the guide tines 165, or by the grate tines 164 of the intake grate 118 and the guide tines 165, until the blade 126 enters the blade housing 132 by continued activation of the actuation system 128. The process may be repeated as desired until a return to expected water-jet drive system 122 efficiency is observed.

As shown in FIGS. 2 and 3, the fouling removal system 110 includes intake grate 118 having relatively narrow grate tines 164 as compared to those grate tines existing on conventional water-jet drive grates known to those of skill in the art. The narrow tines 164 are arranged to ensure maximum available water flow through to the water-jet drive impeller or impellers while maintaining a mechanism for capturing fouling debris such as seaweed and eel grass. The guide 165 tines are similarly shaped in width.

The intake grate 118 is preferably a unitary device including a flange 166 from which the grate tines 164 and the guide tines 165 extend across intake opening 168. The flange 166 forms an integral part of and connection to the rear mounting plate 142. Each of the grate tines 164 and the guide tines 165 may also include a tapered end 170 at forward end 134 in conjunction with forward mounting plate 138. Alternatively, the cutting system 110 may be affixed to an intake grate supplied by the original equipment manufacturer. In that case, the forward mounting plate 138 and the rear mounting plate 142 would be affixed to the perimeter of the existing intake grate and the blade position in relation to the tines 164 and 165 adjusted as necessary.

The cutting system 110 of the present invention may further include the optional cutter stud 116, which is shown in a specific example in FIGS. 4-7. The cutter stud 116 has two members, a first member 191 and a second member 192. The first member 191 and the second member 192 are connected to, or are integral with, each other and form a single angled conduit 184. The cutter stud 116 is removably affixable at second member 192 to interior surface 172 of the housing 174 of the water-jet drive system 122 in close proximity to the impeller 120 at the upstream side thereof. For example, second member 192 of the stud 116 may be removably affixed to the interior surface 172 by using one or more fastening studs 188. The single angled design of the stud 116 allows maximum flow of water through the stud 116 to the impeller 120. The cutter stud 116 may be used in combination with the cutter arm system 114 or it may be a stand-alone device. It is arranged to remove debris stuck or attached to the impeller 120 and carried around as the impeller 120 rotates. The cutter stud 116 is therefore suitable for maintaining maximum efficiency of the impeller 120 itself. This also generally translates into enhancing the overall fuel efficiency of the water-jet drive system 122 and, as a result, the watercraft 112.

The cutter stud 116 includes a sharpened cutting edge 176 on end 191*a* of the first member 191 by which blades 178 of the impeller 120 pass as they rotate. The length of the sharpened cutting edge 176 on end 191*a* can be sized to minimize the distance between it and the hub of the impeller 20. The cutting edge 176 may include carbide. The first member 191 is preferably sized and shaped on end 191*a* to match the profile of the impeller 120 and is sloped at its forward location to minimize water flow disruption. Further, the narrow profile of the cutter stud 116 by the single-angled arrangement of the members 191 and 192 also minimizes water flow disruption. Overall, this arrangement ensures that any debris stuck to the blades 178, between blade tips 180 and/or the interior surface 172 of the housing 174, contacts the cutting edge 176 and is severed such that it will pass through the impeller 120 in relatively small pieces. The cutter stud 116 is preferably of a length sufficient to extend near to the impeller shaft 182, but is not limited to that length and may therefore be shorter.

It is to be understood that the cutter stud 116 may be attached in other ways or may be permanently attached to the housing 174. For example but in no way limited thereto, the fastening stud 188 may be formed integrally with one of the members of the stud 116, such as second member 192, and thereby either minimally intrude into the single-angled conduit 184, or not extend at all into that space. It is also to be understood that the stud 116 is not limited to the design of the specific example, and therefore the stud 116 may be alternatively arranged in any reasonably equivalent form thereof with the goal of minimizing adverse impact on water flow through the housing 174. For example but in no way limited thereto, the stud 116 may be fabricated as a single integral piece. That is, the first member 191, the second member 192 and the fastening studs 188 are formed as a single structure. Optionally, two or more of those components may be separate structures joined together in some manner.

In an alternative embodiment of the invention related to the cutter stud 116, the housing 174 may be modified to include oversized holes with dimensions that exceed the outside dimensions of the fastening studs 188. Because minimizing the spacing between the cutter stud 116 and the impeller 120 is advantageous, the oversized holes may be used to aid in the installation of the cutter stud 116 as close as desired to the impeller 120 as possible, rather than going through the process of approximating positions for the entry holes in the housing 174 for the fastening studs 188 by trial and error. Once the desired position for the fastening studs 188 is established by moving them within the oversized holes of the housing 174, the fastening studs 188 may be secured so that the cutter stud 116 is in a desired position with respect to the impeller 120. The fastening studs 188 may further be secured in position by filling the oversized holes with a filler, such as epoxy, for example. Optionally, a bushing or tube may be used within each of the oversized holes as a sleeve for the fastening stud 188. Once the desired position of the cutter stud 116 has been established adjacent to the impeller 120, the fastening studs 188 contained in the bushings may be tightened. The filler may then be used to secure the bushing in the slot 201. This arrangement allows for easy removal and replacement of the fastening studs 188, knowing that the positioning of the bushing, which is fixed in the filler in the oversized hole, is correct for the next set of replacement fastening studs 188.

The components of the cutting system 110 may be selected based upon the environment within which they will perform, ease of manufacture, durability, compatibility with other components of the watercraft 112 and pricing. For example, one or more of the components may be made of nonmetallic materials. In addition, one or more components may be fabricated of metallic materials. In the preferred embodiment of the present invention, the components of the cutting system 110 are made of a corrosion-resistant material, such as stainless steel, and cutting surfaces may include carbide. The hydraulic cylinder 146 may be of the type generally commercially available and known to those skilled in the art. The hydraulic cylinder 146 may be joined to manually operable or automatically operable hydraulic pumps or other hydraulic fluid supply means in a manner well understood by those skilled in the art.

The improved cutting system for fouling removal systems of the present invention including the cutter arm system 114 and the optional improved cutter stud 116 enable the operator of a watercraft having a water-jet drive system 122 to remove fouling debris from the intake grate 118, the impeller 120, or both when a reduction in operating efficiency is observed. The operator may conduct such removal quickly and conveniently without going through the ad hoc manual steps previously described. No impeller transmission is required to effect debris removal. The operation of the watercraft is generally safer as sudden unexpected slowing or halting of the watercraft as a result of debris clogging of the intake is quickly and easily eliminated.

The present invention has been described with respect to various combinations of preferred components. Nevertheless, it is to be understood that various modifications may be made without departing from the spirit and scope of the invention as described by the following claims.

What is claimed is:

1. A cutting system to aid in the removal of debris from the intake of a water jet drive of a watercraft, wherein the water jet drive includes a housing with an impeller therein, and wherein the intake includes a grate with a plurality of grate tines, the grate having a grate frame, the system comprising:

a. an actuator connectable to the watercraft;

b. a blade connected to the actuator, wherein the blade is arranged to pass along the grate upon actuation of the actuator without changing a position of the grate; and c. one or more guide tines joined to the grate, wherein each of the one or more guide tines is configured to enable the blade to pass over the grate tines between the grate tines and the guide tines to restrict movement of the blade away from the grate.

2. The system as claimed in claim 1 further comprising a housing connectable to the grate frame, wherein the housing is arranged to store therein the blade out of the path of water flow into the intake.

3. The system as claimed in claim 1 wherein the actuator includes a hydraulic arm and a pivot assembly configured to be positioned out of the flow of water through the grate, wherein the hydraulic arm is affixed to the blade, and wherein the pivot assembly includes a bolt around which the blade pivots upon actuation of the hydraulic cylinder.

4. The system as claimed in claim 3 further comprising a controller coupled to the hydraulic arm to control actuation of the hydraulic arm.

5. The system as claimed in claim 1 wherein the housing for the impeller includes an interior surface, the device further comprising a cutter stud affixable to the interior surface of the housing adjacent to the impeller, wherein the cutter stud is arranged to cut debris stuck to the impeller as the impeller rotates.

6. A cutting system to aid in the removal of debris from the intake of a water jet drive of a watercraft, wherein the water jet drive includes a housing with an impeller therein, the system comprising:

a. a grate having a grate frame, wherein the grate is affixable to the watercraft so that, when affixed to the watercraft, water entering or exiting the water jet drive intake must pass through the grate and wherein the grate includes a plurality of grate tines;

b. an actuator connectable to the watercraft;

c. a blade connected to the actuator, wherein the blade is arranged to pass along the grate upon actuation of the actuator without changing a position of the grate; and d. one or more guide tines joined to the grate, wherein each of the one or more guide tines is configured to enable the blade to pass over the grate tines between the grate tines and the guide tines to restrict movement of the blade away from the grate.

7. The system as claimed in claim 6 further comprising a housing connectable to the grate frame, wherein the housing is arranged to store therein the blade out of the path of water flow into the intake.

8. The system as claimed in claim 6 wherein the actuator includes a hydraulic arm and a pivot assembly configured to be positioned out of the flow of water through the grate, wherein the hydraulic arm is affixed to the blade, and wherein the pivot assembly includes a bolt around which the blade pivots upon actuation of the hydraulic cylinder.

9. The system as claimed in claim 8 further comprising a controller coupled to the hydraulic arm to control actuation of the hydraulic arm.

10. The system as claimed in claim 6 wherein the housing for the impeller includes an interior surface, the device further comprising a cutter stud affixable to the interior surface of the housing adjacent to the impeller, wherein the cutter stud is arranged to cut debris stuck to the impeller.

11. The system as claimed in claim 6 wherein the grate includes a flange affixed to the grate frame and the plurality of grate tines and guide tines affixed to the flange.

12. The system as claimed in claim 11 wherein each of the plurality of grate tines and guide tines is tapered at one end thereof.

13. The system as claimed in claim 11 wherein the grate tines are spaced from one another to maximize water flow therebetween.

14. The system as claimed in claim 5 wherein the cutter stud is a single angled structure sized and shaped to match a profile of the impeller.

15. The device as claimed in claim 14 wherein the cutter stud is arranged to be positionable adjacent to the impeller with a tip near a shaft of the impeller.

16. The device as claimed in claim 14 wherein the cutter stud includes a first member and a second member integrally formed together, wherein the second member includes one or more fastening studs integrally formed therewith, and wherein the interior surface of the housing includes one or more oversized holes corresponding in number to the number of fastening studs and arranged to enable adjustment of the cutter stud on the interior surface in relation to the impeller before fixing the cutter stud in position.

17. A cutting system to aid in the removal of debris clogging a water jet drive of a watercraft, wherein the water jet drive includes a water intake and a housing with an impeller therein, the system comprising:

a. a grate having a grate frame, wherein the grate includes a plurality of grate tines and wherein the grate is affixable to the watercraft so that, when affixed to the watercraft, water entering or exiting the water jet drive intake must pass through the grate;

b. a housing connectable to the grate frame, c. an actuator connectable to the watercraft;

d. a blade connected to the actuator, wherein the blade is arranged to pass along the grate upon actuation of the actuator without changing a position of the grate, and wherein the housing is arranged to store therein the blade out of the path of water flow into the intake;

e. one or more guide tines joined to the grate, wherein each of the one or more guide tines is configured to enable the blade to pass over the grate tines between the grate tines and the guide tines to restrict movement of the blade away from the grate;

f. a cutter stud affixable to the interior surface of the housing adjacent to the impeller, wherein the cutter stud is arranged to cut debris stuck to the impeller as the impeller rotates; and g. a controller coupled to the actuator.

18. The system as claimed in claim 17 wherein the actuator includes a hydraulic arm and a pivot assembly configured to be positioned out of the flow of water through the grate, wherein the hydraulic arm is affixed to the blade, and wherein the pivot assembly includes a bolt around which the blade pivots upon actuation of the hydraulic cylinder.

19. The system as claimed in claim 17 wherein the grate includes a flange affixed to the grate frame and a plurality of tines affixed to the flange, and wherein each of the plurality of tines is tapered at one end thereof.

20. The system as claimed in claim 17 wherein the cutter stud is sized and shaped to match a profile of the impeller.

21. The system as claimed in claim 1 wherein at least one of the one or more guide tines is slotted to include an upper structure and a lower structure arranged to enable the blade to pass between the upper structure and the lower structure.

22. The system as claimed in claim 6 wherein at least one of the one or more guide tines is slotted to include an upper structure and a lower structure arranged to enable the blade to pass between the upper structure and the lower structure.

23. The system as claimed in claim 17 wherein at least one of the one or more guide tines is slotted to include an upper structure and a lower structure arranged to enable the blade to pass between the upper structure and the lower structure.

* * * * *